US006223870B1

(12) United States Patent
Godshaw

(10) Patent No.: US 6,223,870 B1
(45) **Date of Patent: *May 1, 2001**

(54) STORAGE AND TRAVEL BAG

(75) Inventor: Donald E. Godshaw, Evanston, IL (US)

(73) Assignee: Travel Caddy, Inc., Des Plaines, IL (US)

( * ) Notice: Subject to any disclaimer, the term of this patent is extended or adjusted under 35 U.S.C. 154(b) by 0 days.

This patent is subject to a terminal disclaimer.

(21) Appl. No.: 09/325,507

(22) Filed: Jun. 3, 1999

Related U.S. Application Data

(63) Continuation-in-part of application No. 08/953,733, filed on Oct. 20, 1997, now Pat. No. 5,918,711.

(51) Int. Cl.[7] ..... A45C 7/00; A45C 13/10

(52) U.S. Cl. ..... 190/107; 190/111; 190/112; 190/901

(58) Field of Search ..... 190/103, 107, 190/102, 111, 112, 901; 383/4

(56) References Cited

U.S. PATENT DOCUMENTS

| | | | | |
|---|---|---|---|---|
| 1,950,118 | * | 3/1934 | Lifton | 190/107 |
| 1,975,294 | * | 10/1934 | Sand | 190/107 X |
| 2,170,379 | * | 8/1939 | Ortt | 190/107 |
| 2,244,887 | * | 6/1941 | Manley | 190/107 X |
| 2,254,578 | * | 9/1941 | O'Brien | 190/107 |
| 3,041,638 | * | 7/1962 | Lo Vico | 190/901 X |
| 3,173,465 | * | 3/1965 | Pastini | 190/107 X |
| 3,777,862 | * | 12/1973 | Zipper | 190/107 |
| 3,994,372 | * | 11/1976 | Geller et al. | 190/107 |
| 4,090,542 | * | 5/1978 | Hacker, Jr. | 190/107 X |
| 4,489,815 | * | 12/1984 | Martinez et al. | 190/107 X |
| 4,588,056 | * | 5/1986 | Bernbaum | 190/107 |
| 4,598,802 | * | 7/1986 | Abenaim | 190/127 X |
| 4,925,021 | * | 5/1990 | Pulichino, Jr. | 190/109 X |
| 5,413,198 | * | 5/1995 | Ferris | 190/107 X |
| 5,566,797 | * | 10/1996 | Van Himbeeck | 190/107 X |
| 5,918,711 | * | 7/1999 | Godshaw | 190/107 |

FOREIGN PATENT DOCUMENTS

| | | | | |
|---|---|---|---|---|
| 28323 | * | 8/1931 | (AU) | 190/102 |
| 4100055 | * | 7/1992 | (DE) | 190/111 |
| 281478 | * | 9/1988 | (EP) | 190/111 |
| 5130910 | * | 5/1993 | (JP) | 383/4 |
| 9321793 | * | 11/1993 | (WO) | 190/111 |

* cited by examiner

*Primary Examiner*—Sue A. Weaver
(74) *Attorney, Agent, or Firm*—Banner & Witcoff, Ltd.

(57) ABSTRACT

A travel and storage bag includes two side sections releasably fastened to an intermediate center section to form the bag into a travel bag. Unfastening the side sections from the center section allows the center section to be folded and stored, reveals pockets and compartments, and allows the bag to be used as a hanging bag and organizer.

14 Claims, 9 Drawing Sheets

FIG. 1
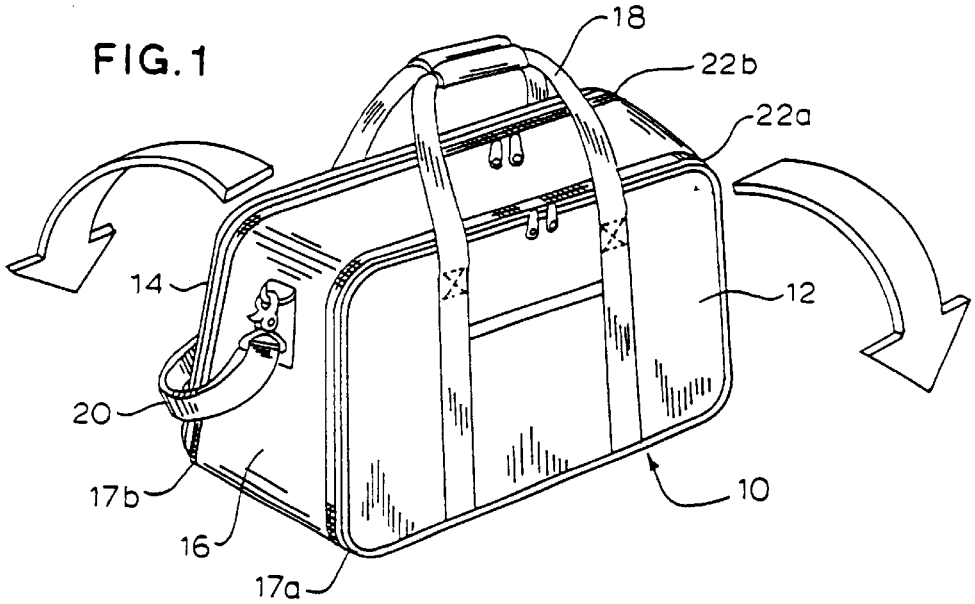
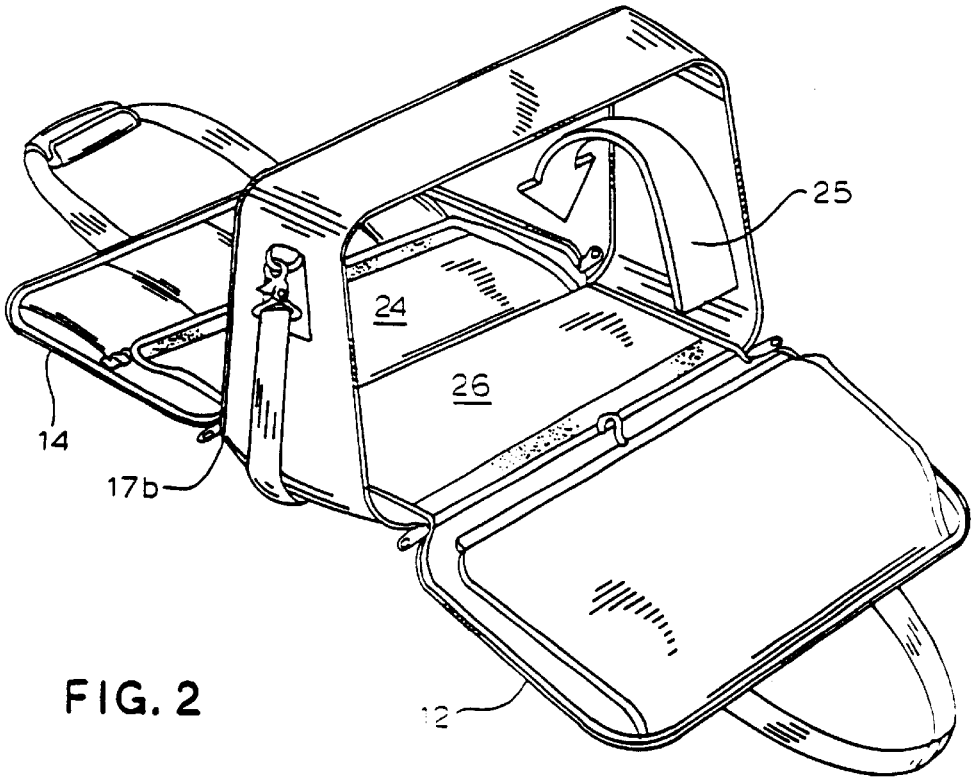
FIG. 2

FIG.6
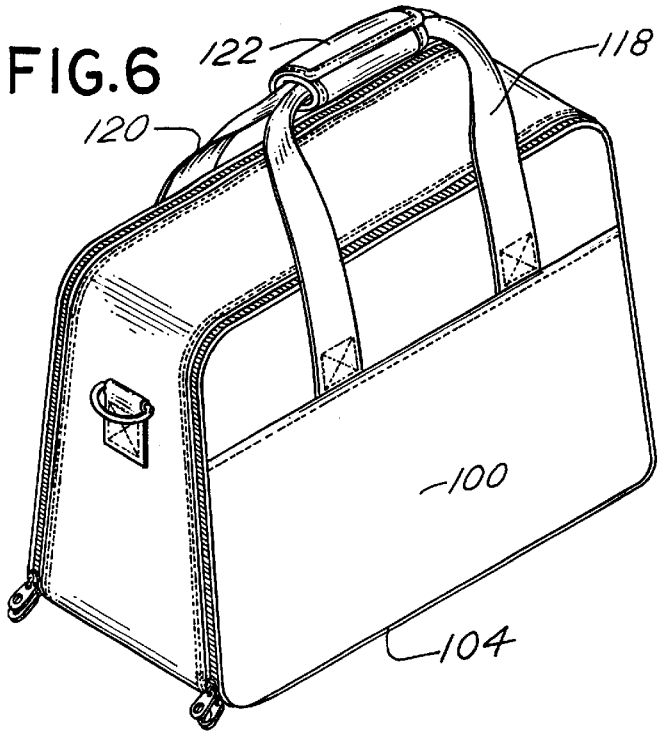
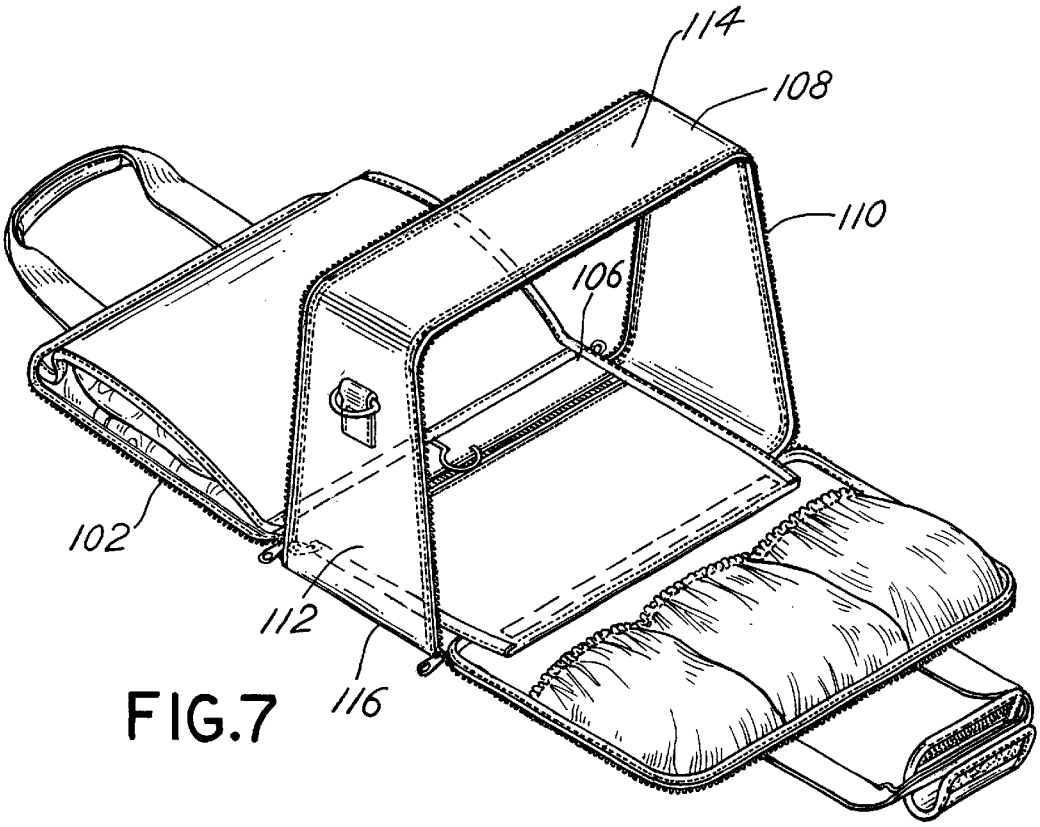
FIG.7

STORAGE AND TRAVEL BAG

CROSS REFERENCE TO RELATED APPLICATION

This is a continuation-in-part to application Ser. No. 08/953,733 filed Oct. 20, 1997, now U.S. Pat. No. 5,918,711 issued Jul. 6, 1999.

BACKGROUND OF THE INVENTION

1. Field of the Invention

The present invention relates generally to luggage or bags used for storage and travel, and more particularly relates to an innovation which facilitates the conversion of such a bag for use as a hanging organizer.

2. Description of the Prior Art

Previously, travel bags have generally exhibited a box style and their use, especially regarding access to articles within, has been accordingly limited. However, when traveling it is often desirable to organize one's belongings and to present them in an accessible manner, yet no item of luggage, and particularly a box style travel bag, has successfully achieved a design which readily converts to an effective organizer.

SUMMARY OF THE INVENTION

Accordingly, it is the principal objective of this invention to provide a travel bag which opens fully and converts into an effective hanging organizer. It is a further object to provide a collapsible center section of the bag that stores out of the way when the bag is used as an organizer.

These and other objectives are accomplished by a bag of a generally box style, having a center section and two side sections, and which is outfitted with a plurality of pockets and compartments therein. Zipper closures fasten the side sections to the center section to form the bag, when used as a travel bag. Unfastening of the sides allows the center section to fold and store under a flap, to allow unrestricted access to the pockets and compartments of the bag (which now presents itself as an organizer).

BRIEF DESCRIPTION OF THE DRAWINGS

FIG. 1 is a perspective view of a travel bag in accordance with the present invention.

FIG. 2 is a perspective view of the travel bag of FIG. 1 with its end sections opened.

FIG. 6 is a perspective view of an alternate construction of a travel bag in accordance with the present invention.

FIG. 7 is a perspective view of the travel bag of FIG. 6 with its end sections opened.

Figure 3:
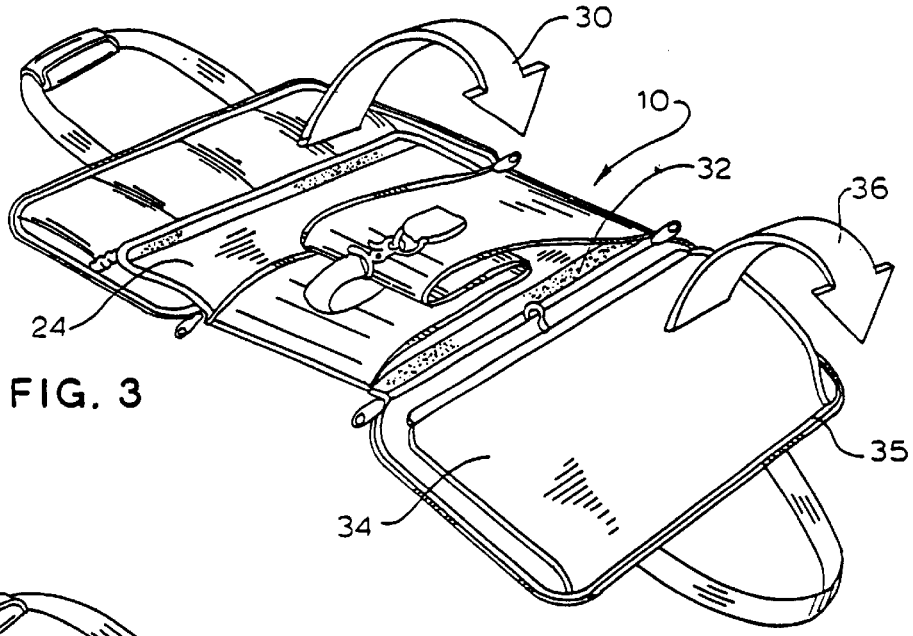
FIG. 3 is a perspective view of the bag of FIGS. 1 and 2 showing the collapse of the center section and closing of a storage and center section retention flap over the center section.

While the invention will be described in connection with a preferred embodiment, it will be understood that it is not the intent to limit the invention to that embodiment. On the contrary, it is the intent to cover all alternatives, modifications, and equivalents as may be included within the spirit and scope of the invention as defined by the appended claims.

DESCRIPTION OF THE PREFERRED EMBODIMENT

Turning first to FIG. 1 there is shown a travel bag in accordance with the present invention. This bag presents an enclosure having a rectangular base member 10 and formed by three sections: A first side section 12, a second side section 14 and a center section 16 intermediate said side sections. The center section and each of the side sections are hinged or otherwise flexibly attached to the base member 10 along the bottom edges 17*a* and 17*b*. Attached to the side sections 12, 14 are handles 18 and attached to the center section 16 is shoulder strap 20, both to facilitate carrying of the bag.

Holding the two side sections 12, 14 to the center section 16 are fastener means 22*a* and 22*b*, in the form of zippers or the like. When unfastened (FIG. 2) the side sections 12, 14 open to lie flat, leaving a hollow center section 16 and exposing a center control member, such as flap 24, shown opened (arrow 25) and available to cover a central area 26.

Figure 4:
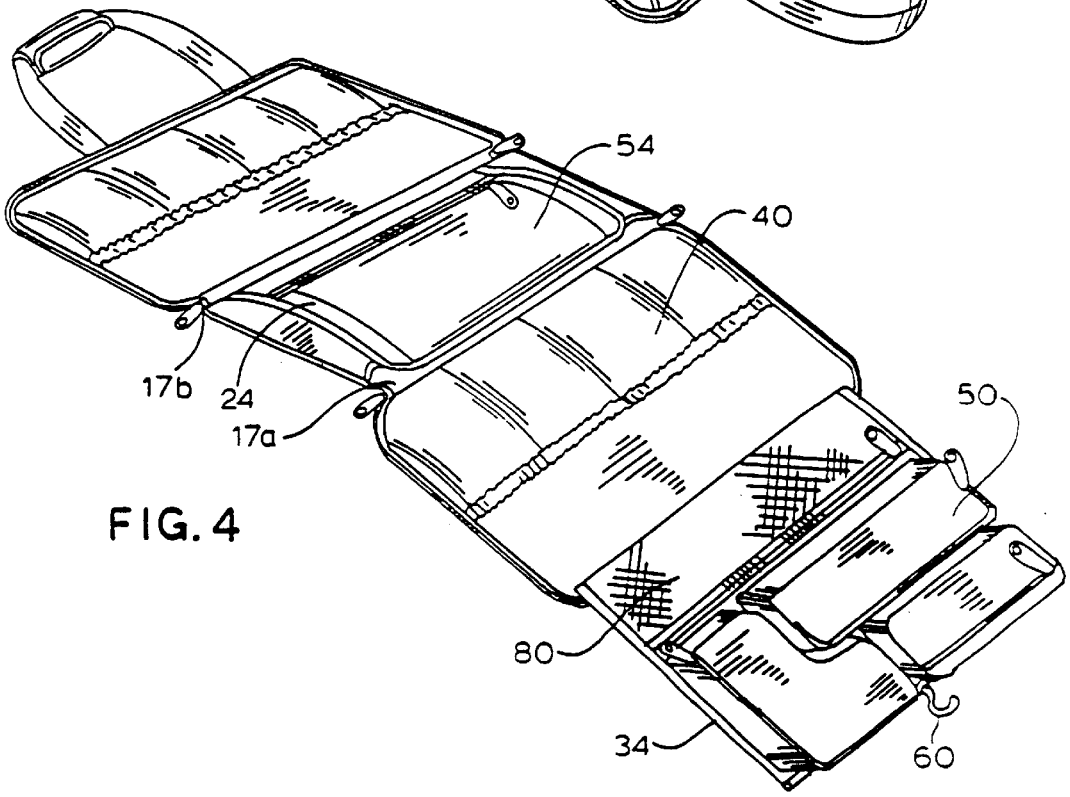
FIG. 4 is a perspective view of the bag of FIGS. 1–3 revealing an additional organizer compartment area.
Figure 5:
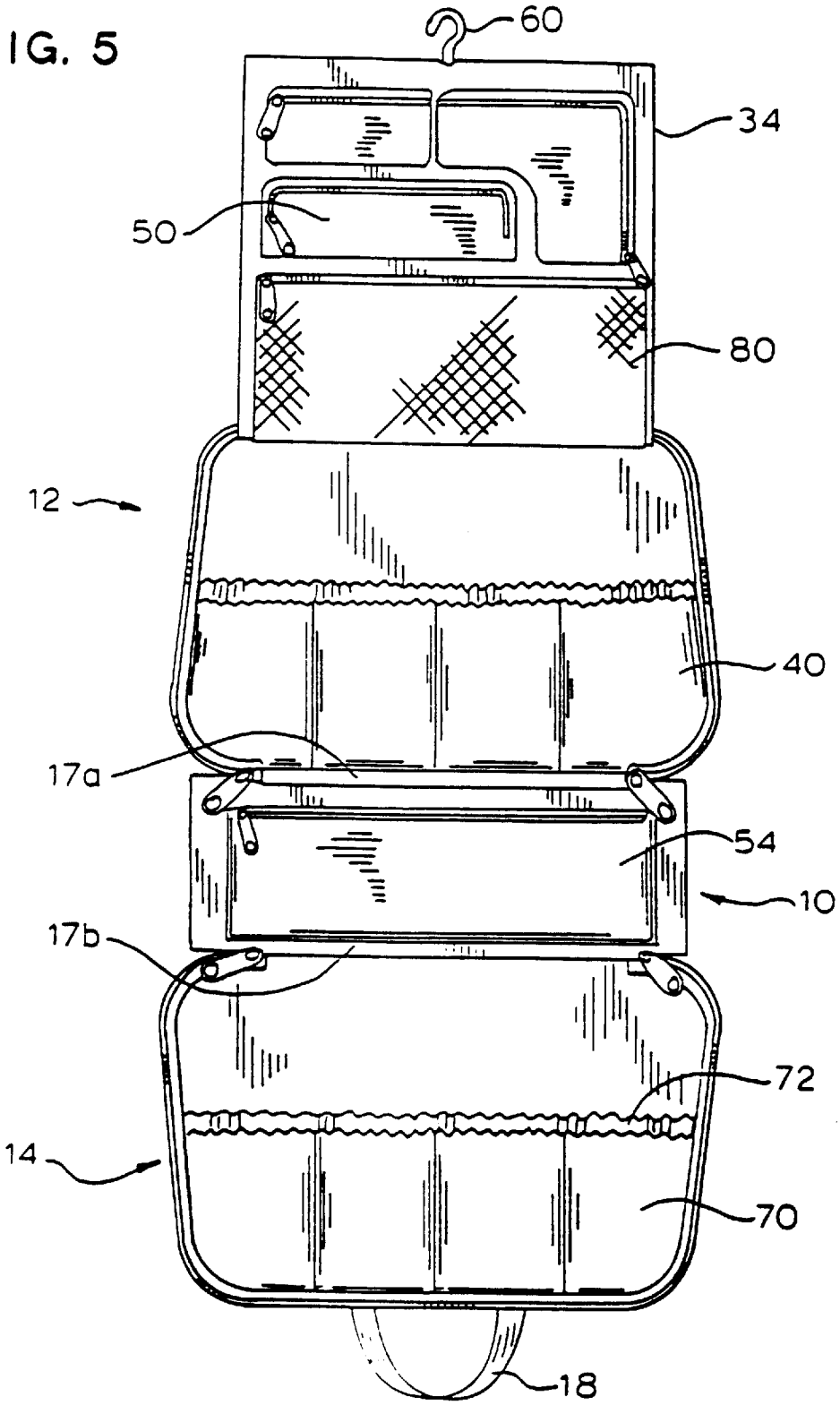
FIG. 5 is a plan view of the bag/organizer of FIG. 4.

As shown in FIG. 3, the upper portion of the center section 16 can now be collapsed and folded within the central area 26, allowing the flap 24 to be replaced over the center section 16, as depicted by the arrow 30. With the flap 24 now covering the center section, fastening or trapping means 32, such as a hook/loop fastener, zipper or the like, is employed to hold the flap 24, and the folded center section 16 thereunder, in place. Additionally, secondary side members 34 which are hinged, or otherwise flexibly attached, to the upper edge 35 of the side sections can now be unfolded (arrow 36) to expose additional organizer features (see FIG. 4).

Numerous and various storage means and organizing features in the form of pockets 40 and compartments 50, including a compartment 54 on the flap 24, are provided within the travel bag along the inside surfaces of the side sections 12 and 14 and on the surfaces of the secondary side members 34 to facilitate storage and organization. With the upper portion of the center section 16 now stored out of the way, the bag can be used effectively as an organizer, either lying flat or hanging from a hook 60 located at one end of the bag/organizer.

In a further feature there are provided pockets 40 and 70 located on the side sections, each having elastic closures 72 at the opening of each pocket, such that each pocket 40, 70 is particularly adapted to receive and store shoes. In yet a further feature, there is provided at least one compartment 80 formed or attached to a side section, or to a secondary side member, and presenting at least one side composed of a mesh material to allow air to circulate therethrough.

Referring next to FIGS. 6 through 10 there is illustrated a second embodiment of the invention. The second embodiment includes a first side panel or section 100 and a second separate side panel or section 102 which are each attached along one edge, e.g. edge 104 and edge 106, to a center flap or section 108. Section 108 has the form generally of a rectangular shaped frame or loop. The center flap or section 108 is foldable and thus includes opposite upstanding, flexible side panels 110 and 112 and a flexible, connecting top panel 114. A bottom panel 116 forms the bottom side of the carrying case. A stiffening board may be included in the bottom panel 116 as an optional feature so that the bottom panel 116 will be rigid. Outside straps 118 are attached, respectively, to the side panels 100 and 102. The straps 118 are connectable by means of a Velcro fastener or strap 122 to form a handle for the bag.

Figure 8:
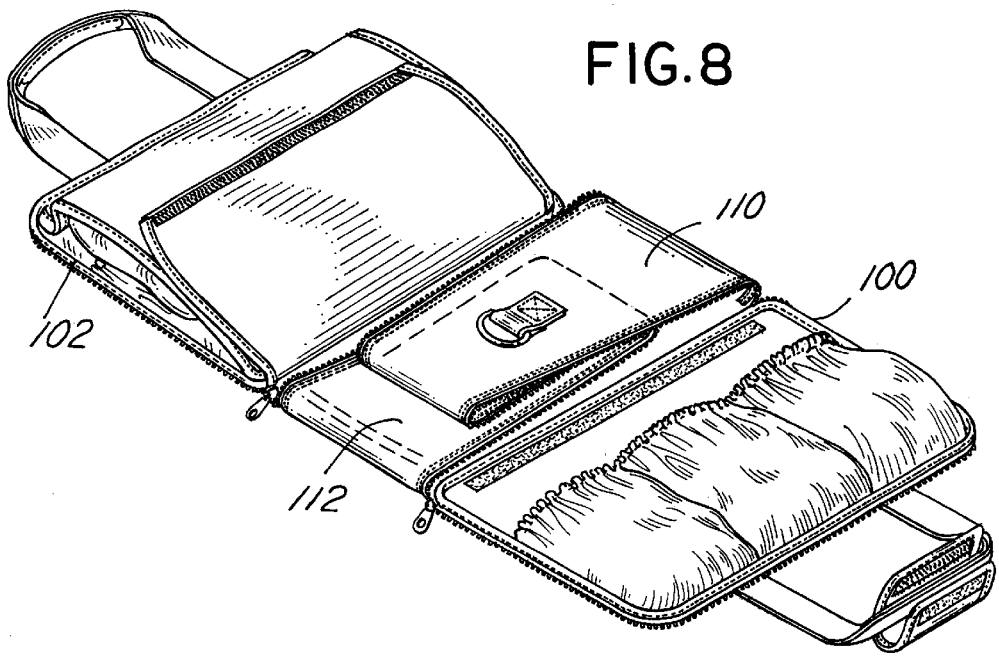
FIG. 8 is a perspective view of the bag of FIGS. 6 and 7 showing the collapse of the center section and closing of the storage and center section retention flap over the center section.
Figure 9:
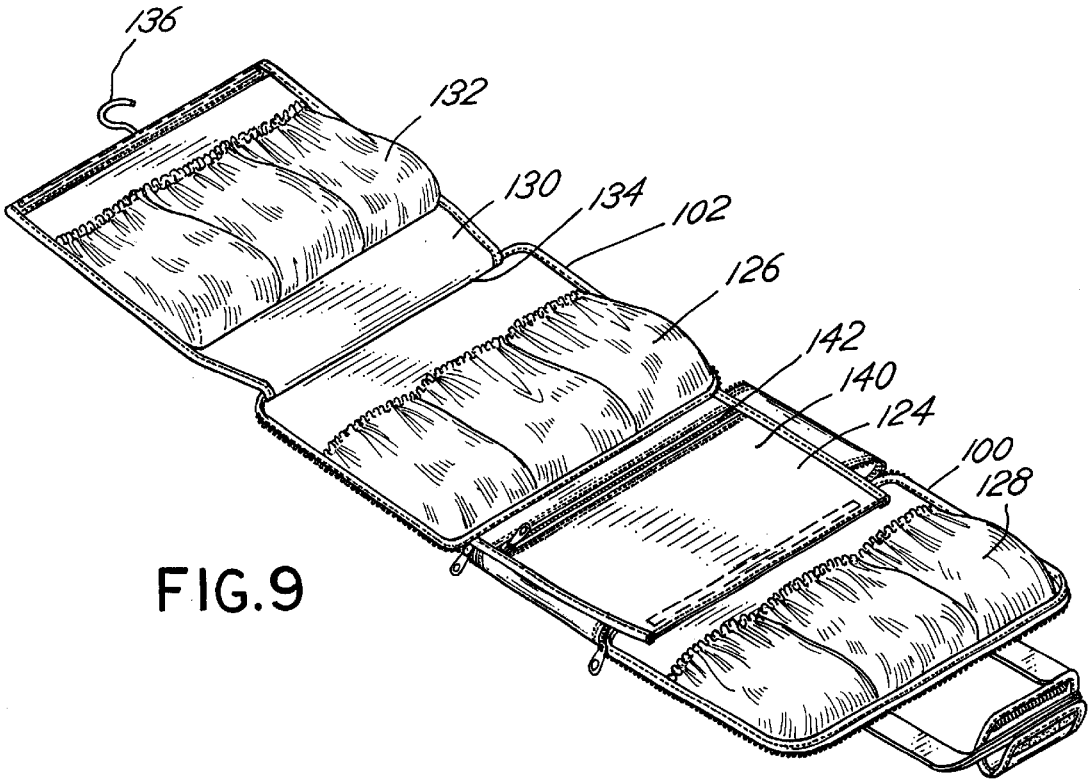
FIG. 9 is a perspective view of the bag of FIGS. 6-8 revealing an array of pockets for storage of shoes.
Figure 10:
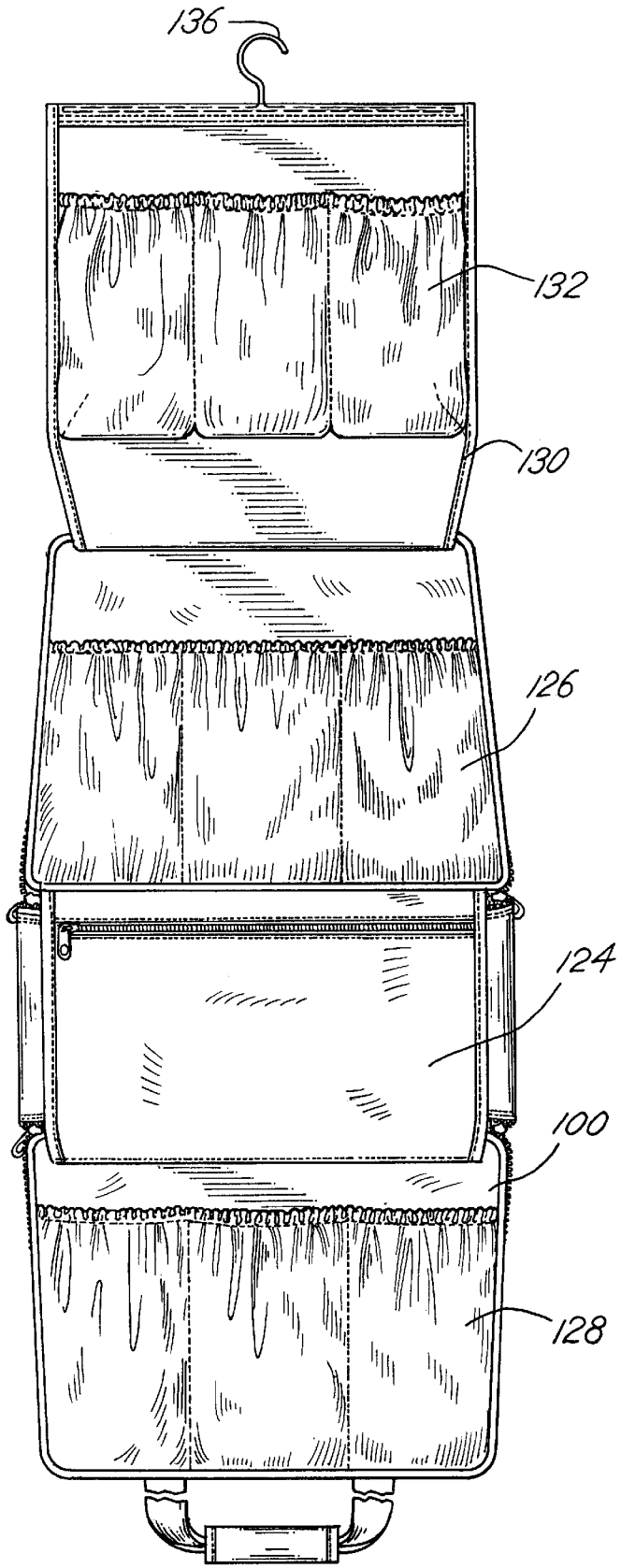
FIG. 10 is a plan view of the bag and organizer of FIG. 9.
Figure 11:
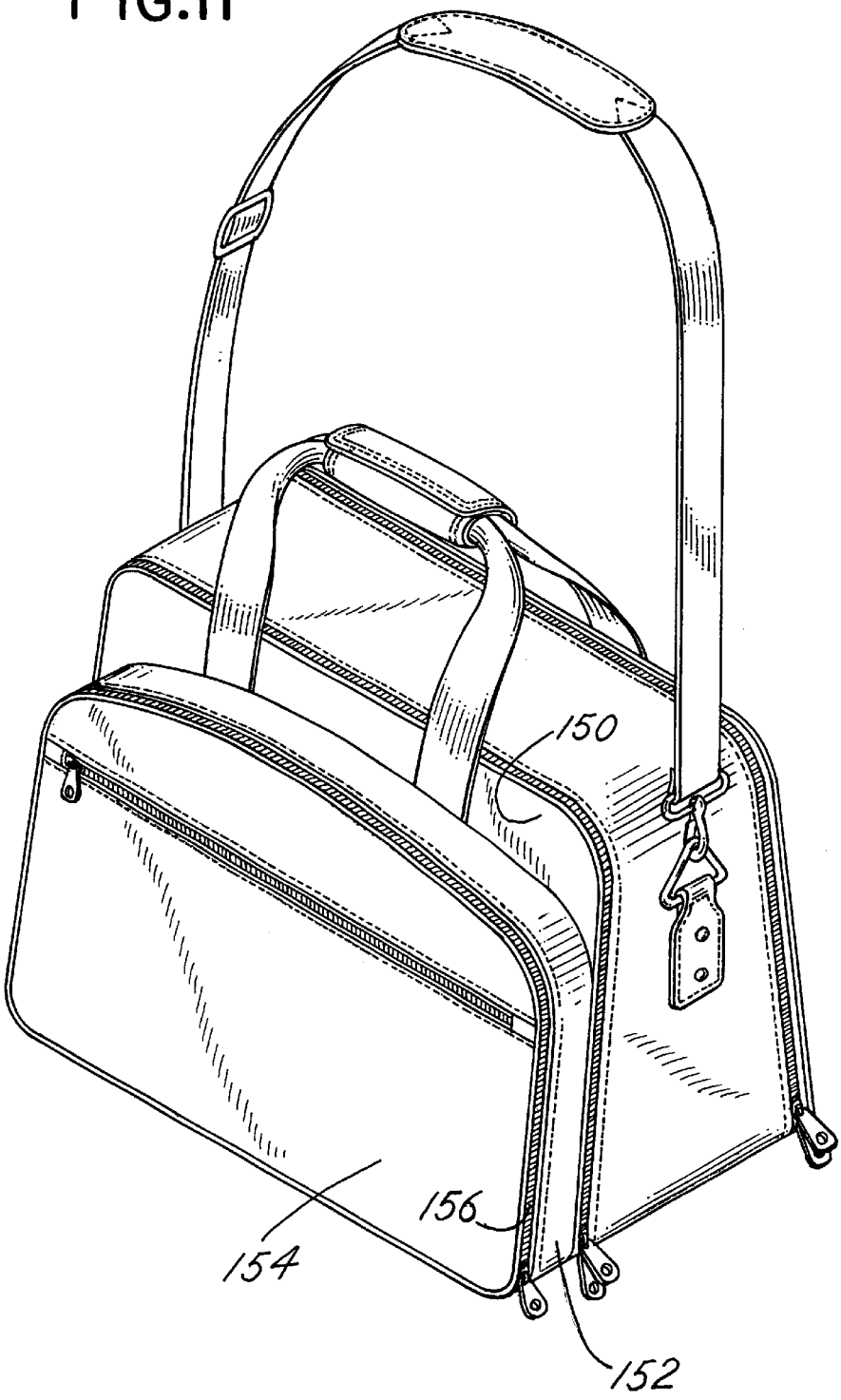
FIG. 11 is a perspective view of a travel bag in accordance with the present invention in the form of a third embodiment.
Figure 12:
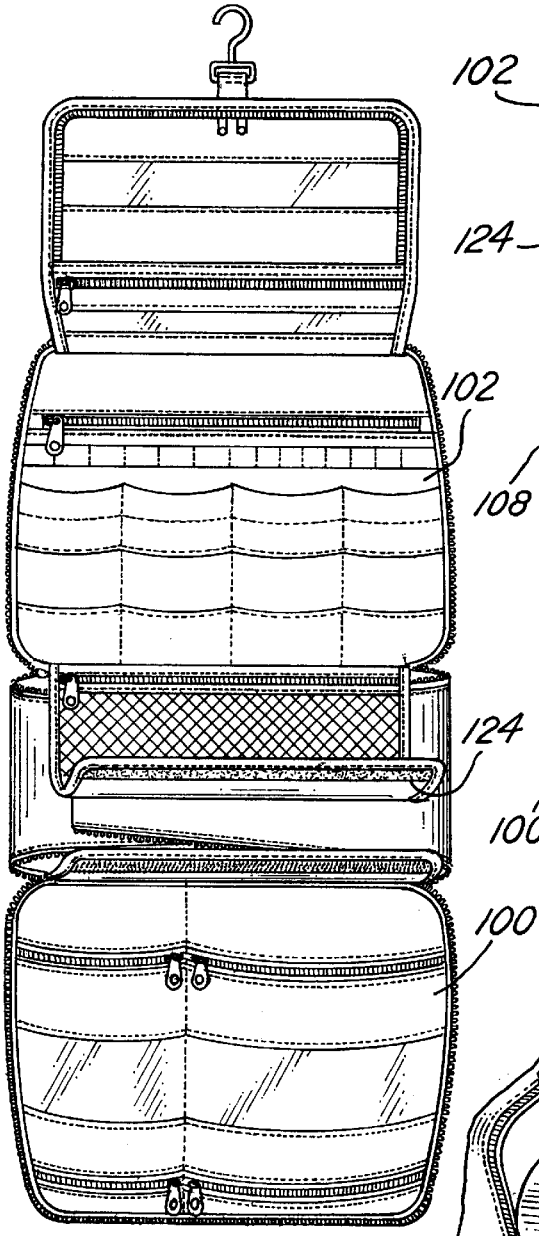
FIG. 12 is a plan view of the bag of FIG. 11.
Figure 13:
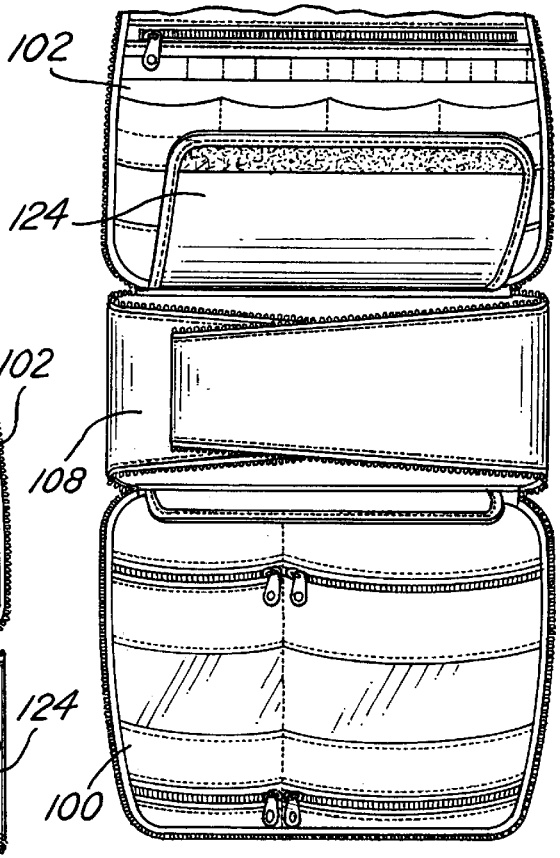
FIG. 13 is a partial plan view of the bag of FIG. 11.

The center section 108 is collapsable and foldable as depicted in FIG. 8 and may be retained in position by a foldover retention flap 124 that folds over bottom panel 116. In this manner the side sections 100 and 102 may be revealed to expose pockets such as pockets 126 and 128 which are specially designed for receipt of shoes. The side section 102 includes a foldover flap 130 which includes shoe pockets 132 and is connected to the side section 102 along a flexible seam 134. Thus, the flap 130 can be folded over flap 102 as shown in FIG. 8. A hook 136 is provided at the top end of flap 130 for hanging the organizer when it is fully opened. Note that all the pockets 126, 128, 132 are oriented so that shoes retained therein are easily accessible and projecting upwardly from pockets 126, 128, 132 in the organizer when it is supported by the hook 136. Zippers may be provided to connect the various panels 100, 102 and 108. Additional zipper pockets such as pocket 140 may be provided with a zipper 142 in the retention flap 124. Though a hook 136 is depicted, other hanging means may be utilized or the handle 120 of the flap 102 may be used.

Figure 14:
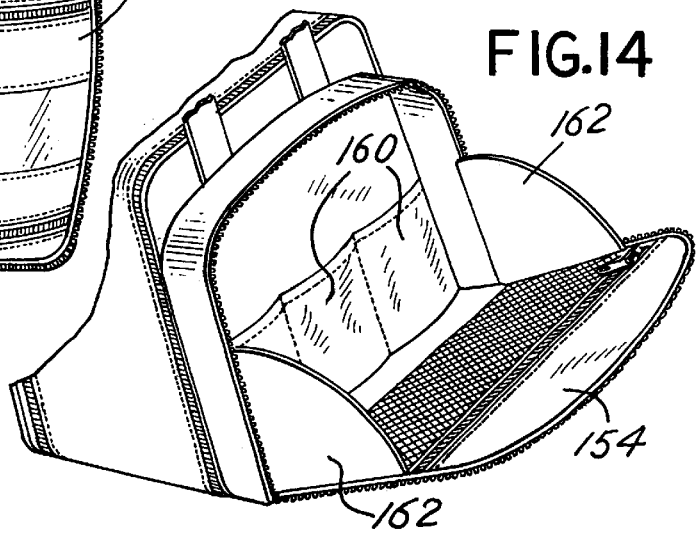
FIG. 14 is a perspective view of a side pocket of the bag of FIG. 11.

FIGS. 11 through 14 depict another embodiment of the invention. In the embodiment of FIGS. 11–14 a side panel 150 includes an additional outside pocket 152 formed or attached thereto. A panel 154 is attached by a zipper 156 to the pocket 152 and may be opened as shown in FIG. 14 to reveal the contents and internal construction of the pocket 152. In the embodiment depicted, the interior of the pocket 152 includes various additional compartments such as compartment 160 for toiletries. Side gussets 162 control or limit the movement of the front flap 154 of pocket 152. The construction of FIGS. 11 through 14 is otherwise quite similar to that previously discussed. The arrangement of pockets and flaps is similar. A center section 108 is foldable and retained by a retention flap 124. Various pockets of different size and configuration for holding various items are provided or included on the interior of the panels 100 and 102.

Figure 15:
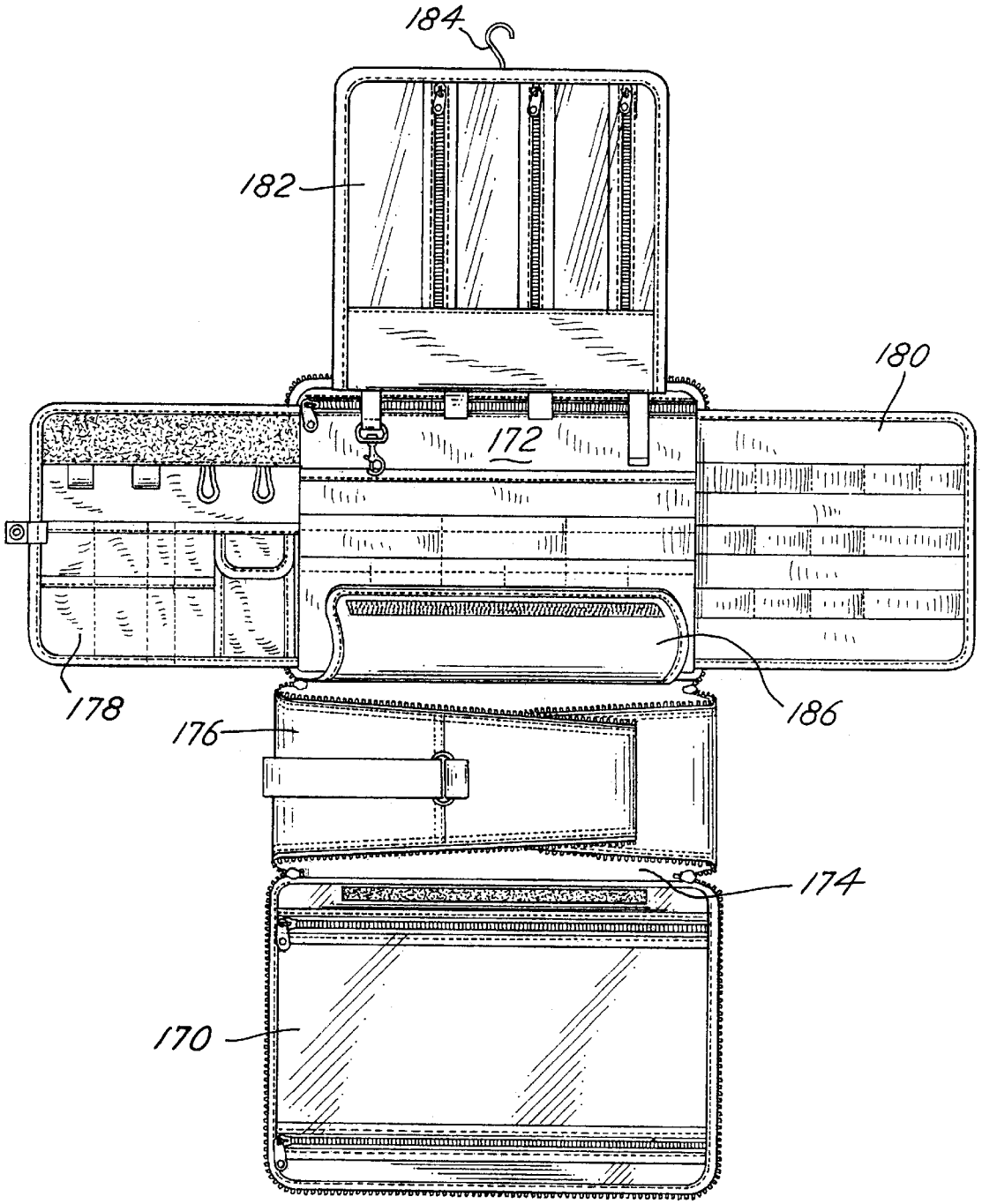
FIG. 15 is a perspective view of a further embodiment of the invention especially adapted for transport of cosmetics and sundries and the like wherein the bag is in the open condition.

FIG. 15 depicts yet a further embodiment of the invention, especially adapted for carrying sundries, cosmetics and the like. The bag depicted in FIG. 15 includes first outer flap 170, a second outer flap 172, a generally rectangular center section 174, and a foldable loop 176 which completes the center section. The bag further includes side panels 178 and 180 which are flexibly hinged to the outside panel 172. A foldover extension or panel 182 is similarly flexibly attached to the panel 172. An optional hook, hanger or other member 184 is provided for the foldover panel 182.

A retention flap 186 is provided to retain the center section, and more particularly, the foldable portion 176 of the center section. As to the other embodiments, zippers or fasteners are provided along three sides of panels 170 and 172 to form the assembly into a closed bag. Various pockets have been arranged in the panels on the inside of the bag. Thus, flaps or panels 170, 172, 178, 180 and 182 all include pockets, zippered or otherwise, which may carry items and may be enclosed within the clothes bag formed by the panels 170 and 172 as well as the bottom center section 174 and foldable center section 176.

From the foregoing description, it will be apparent that modifications can be made to the apparatus and method for using same without departing from the teachings of the present invention. Accordingly, the scope of the invention is only to be limited as necessitated by the accompanying claims.

What is claimed is:

1. A storage and travel bag comprising:

base member of substantially rectangular shape including an inside, a first edge, a second edge opposite the first edge, and opposite ends extending between the first edge and second edge;

a first side section hingedly attached to said base member along said first edge;

a second side section hingedly attached to said base member along said second edge;

a flexible center section, closed loop connected to the opposite ends of the base member, said loop extendable generally to form a rectangle with the base member and also collapsible and foldable against the base member;

fastening means along said first and second side sections for joining said respective side sections to said center section loop when extended to thereby open and close the bag, said first and second side sections positionable in the plane of the base for access to the contents of the bag; and means attached to the inside of the base member for holding the collapsed center section loop in the collapsed position.

2. The storage and travel bag of claim 1 wherein said means for holding said center section in said collapsed position comprises a superposed trapping member releasably attached to said base section.

3. The storage and travel bag of claim 2 wherein said trapping member is hinged to said base member along the first edge and releasably attached to said base member along the second edge.

4. The storage and travel bag of claim 3 wherein said trapping member is releasably attached by fastener means.

5. The storage and travel bag of claim 1 further comprising a secondary side member hingedly connected to said first side section for providing additional compartments.

6. The storage and travel bag of claim 5 further comprising a compartment attached to said secondary side member having at least one side thereof formed of a mesh material.

7. The storage and travel bag of claim 1 further comprising a plurality of pockets and compartments affixed along said first and second side sections.

8. A storage and travel bag comprising; in combination:

a bag base member with an inside, a first side edge and a second opposite side edge generally parallel to the first side edge and spaced therefrom;

a first side section hinged to the first side edge;

a second side section hinged to the second side edge, said first and second side sections foldable to the plane of the base to provide access to the contents of the bag;

said base including a foldable, closed loop defining the top and ends of the bag, said side sections attachable to the closed loop to form an enclosed bag, said foldable loop collapsible on the inside of the base member when the first and second side sections are detached therefrom; and trapping means for retaining the foldable, collapsed loop against the base member when the side sections are detached from the loop.

9. The bag of claim 8 further including a hook element attached to one of the side sections for suspending the open bag.

10. The bag of claim 8 further including compartments in the side sections to provide an organizer.

11. The bag of claim 8 further including at least one foldable flap attached to a side section and foldable to the interior of the bag when the side sections are attached to the foldable loop.

12. The bag of claim 11 wherein the foldable flap is attached to a side section along a connection generally parallel to a side edge.

13. The bag of claim 11 wherein the foldable flap is attached to a side section along a connection generally transverse to a side edge.

14. The bag of claim 11 wherein the foldable flap includes compartments.

* * * * *